US006536924B2

(12) United States Patent
Segretto

(10) Patent No.: US 6,536,924 B2
(45) Date of Patent: Mar. 25, 2003

(54) MODULAR LIGHTING UNIT

(75) Inventor: Perry Segretto, Elmhurst, IL (US)

(73) Assignee: JJI Lighting Group, Inc., Greenwich, CT (US)

( * ) Notice: Subject to any disclaimer, the term of this patent is extended or adjusted under 35 U.S.C. 154(b) by 0 days.

(21) Appl. No.: 09/793,913

(22) Filed: Feb. 28, 2001

(65) Prior Publication Data

US 2002/0118537 A1 Aug. 29, 2002

(51) Int. Cl.[7] ..... F21V 7/20

(52) U.S. Cl. ..... 362/345; 362/247; 362/294; 362/373

(58) Field of Search ..... 362/245, 247, 362/294, 345, 373

(56) References Cited

U.S. PATENT DOCUMENTS

| | | | | | |
|---|---|---|---|---|---|
| 1,870,241 | A | | 8/1932 | Dorey | |
| 2,352,804 | A | | 7/1944 | Schepmos | 362/222 |
| D166,034 | S | | 2/1952 | Gary | D26/85 |
| 2,770,717 | A | | 11/1956 | Schwartz et al. | 362/222 |
| 2,981,829 | A | | 4/1961 | Rosenblatt | |
| 2,988,633 | A | | 6/1961 | Rosenfield | 362/219 |
| D191,628 | S | | 10/1961 | Muller | D26/76 |
| 3,464,727 | A | | 9/1969 | Pascucci | 362/374 |
| 3,524,050 | A | | 8/1970 | Gustine | 362/219 |
| 4,001,571 | A | * | 1/1977 | Martin | 174/49 |
| 4,180,851 | A | * | 12/1979 | Ericson, Jr. | 362/294 |
| 4,234,914 | A | * | 11/1980 | Boesen | 362/240 |
| 4,503,360 | A | * | 3/1985 | Bedel | 313/19 |
| D286,916 | S | | 11/1986 | Worrell | D26/85 |
| 4,639,841 | A | * | 1/1987 | Salestrom et al. | 362/227 |
| 4,726,781 | A | | 2/1988 | Bernhaut et al. | 362/219 |
| 4,816,969 | A | | 3/1989 | Miller | D26/85 X |
| 4,866,583 | A | * | 9/1989 | Targetti | 248/343 |
| 4,907,137 | A | * | 3/1990 | Schladitz et al. | 362/145 |
| 4,998,188 | A | | 3/1991 | Degelmann | 362/147 |
| 5,091,828 | A | | 2/1992 | Jincks | 362/35 |
| 5,099,403 | A | * | 3/1992 | Turner | 222/113 |
| 5,113,328 | A | | 5/1992 | Foster et al. | 362/223 |
| 5,124,896 | A | | 6/1992 | Bentley | 362/223 |
| 5,136,489 | A | * | 8/1992 | Cheng et al. | 362/285 |
| D330,269 | S | | 10/1992 | Hong | D26/76 |
| 5,226,724 | A | | 7/1993 | Kanarek | 362/219 |
| 5,292,257 | A | | 3/1994 | Milan | 439/214 |
| 5,392,204 | A | * | 2/1995 | Schumaker | 362/294 |
| 5,404,279 | A | * | 4/1995 | Wood | 362/145 |
| D359,374 | S | | 6/1995 | Weinstock | D26/80 |
| 5,521,805 | A | | 5/1996 | Lim | 362/221 |
| 5,582,522 | A | | 12/1996 | Johnson | 439/214 |
| 5,658,067 | A | * | 8/1997 | Engle et al. | 362/219 |
| D383,560 | S | | 9/1997 | Palmer | D26/72 |
| D386,278 | S | | 11/1997 | Engle et al. | D26/76 |
| 5,702,176 | A | * | 12/1997 | Engle | 362/219 |
| 5,823,655 | A | | 10/1998 | Brooks | 362/145 |
| 5,909,955 | A | * | 6/1999 | Roorda | 362/133 |
| 6,068,384 | A | * | 5/2000 | Tyson et al. | 362/153.1 |

* cited by examiner

*Primary Examiner*—Sandra O'Shea
*Assistant Examiner*—Ismael Negron
(74) *Attorney, Agent, or Firm*—Fitzpatrick, Cella, Harper & Scinto

(57) ABSTRACT

The lighting fixture which comprises an elongated housing having a top wall and a bottom wall. The width of the top wall is greater than the width of the bottom wall, which has a free edge located below the top wall providing an opening for the emission of light from at least one light bulb mounted in the housing and projecting beyond the free edge of the bottom wall. A reflector is mounted in the housing and has a reflector wall located between the top wall and the at least one bulb. The reflector has a plurality of air vents formed in it and the top wall of the housing also has a plurality of vents formed therein, offset from the air vents in the reflector wall, whereby air below the reflector wall heated by the bulb flows through the air vents in the reflector, and out the air vents in the top wall, but the emission of light through the top wall is blocked.

16 Claims, 7 Drawing Sheets

MODULAR LIGHTING UNIT

FIELD OF THE INVENTION

The present invention relates to modular lighting units, and more in particular to undercabinet lighting systems in which a plurality of individual lighting modules can be electrically connected directly to each other.

BACKGROUND OF THE INVENTION

Undercabinet lighting has previously been provided by a variety of manufacturers. Such lighting units typically consist of relatively thin fixtures hardwired together and to a source of electrical current.

Some attempts have been made to reduce the amount of labor required for the installation of conventional undercabinet lighting systems. For example, Salestrom, et al. in U.S. Pat. No. 4,639,841, disclose a modular lighting system in which undercabinet-type lighting is provided in small individual modular units that plug directly to one another. However, these units use exposed electrical plugs at their ends. On the other hand, U.S. Pat. No. 5,658,067 to Engle, et al., discloses a modular lighting unit which uses male and female double insulated electrical plug means at its opposite ends electrically connecting the units together, thereby avoiding the need for hardwired connections. That system was specifically designed for use with a fluorescent light bulb which utilized 120 v current with a heavy ballast.

It is the object of the present invention to provide a is modular lighting unit which is simple in construction and can be easily installed by unskilled workers.

Yet another object of the present invention is to provide a modular lighting system using very small lighting elements, such as Xenon bulbs, which can be controlled with a dimmer. It is advantageous that a standard incandescent can be used, because there is no low voltage transformer in the module.

Another object of the present invention is to provide a lighting system in which a plurality of small lighting modules can be connected together safely in end-to-end relationship secured to one another.

A still further object of the present invention is to provide a modular lighting system which will enable the user to provide varying lengths for an overall lighting arrangement.

A still further object of the present invention is to provide a modular undercabinet lighting system which is relatively simple to manufacture, easy to service, and to install.

SUMMARY OF THE INVENTION

A modular lighting fixture constructed in accordance with the present invention includes an elongated housing having a top wall, a bottom wall and a pair of opposed side walls. The top wall of the fixture has a width which is greater than the width of the bottom wall, whereby the bottom wall has a longitudinal free edge located below the top wall which forms a gap in the housing through which light may be projected downwardly. A plurality of incandescent Xenon light bulbs are mounted in the housing and project beyond the free edge of the bottom wall, but below the top wall. A reflector is mounted in the housing and has a reflector wall located between the top wall and the bulbs. The reflector also has a plurality of longitudinally-spaced air vents formed in the reflector wall each consisting of at least one slot. The top wall of the housing also has a plurality of longitudinally-spaced air vents formed therein, each consisting of at least one slot, with the slots of the top wall of the housing being located between the slots of the reflector wall when the fixture is viewed in plan, so that air below the reflector wall heated by the bulbs will flow through the air vents in the reflector, out the air vents in the top wall while light passage out of the top wall is blocked.

The Xenon light bulbs are mounted on a circuit board which is positioned generally perpendicular to and below the top wall. The reflector has a rear reflector wall adjacent the circuit board and a plurality of apertures formed therein through which the Xenon bulbs extend. As a result, light is directed downwardly beyond the free edge of the lower wall of the housing.

Blind mating connectors are mounted on the opposite ends of the circuit board adjacent the side walls of the housing, with said side walls having openings formed therein that supply access to the blind mating interconnect connectors to allow connection to either power modules or adjacent lamp modules.

The above, and other objects, features and advantages of this invention will be apparent in the following detailed description of an illustrative embodiment thereof, which is to be read in connection with the accompanying drawings, wherein:

DESCRIPTION OF THE PREFERRED EMBODIMENTS

Figure 1:
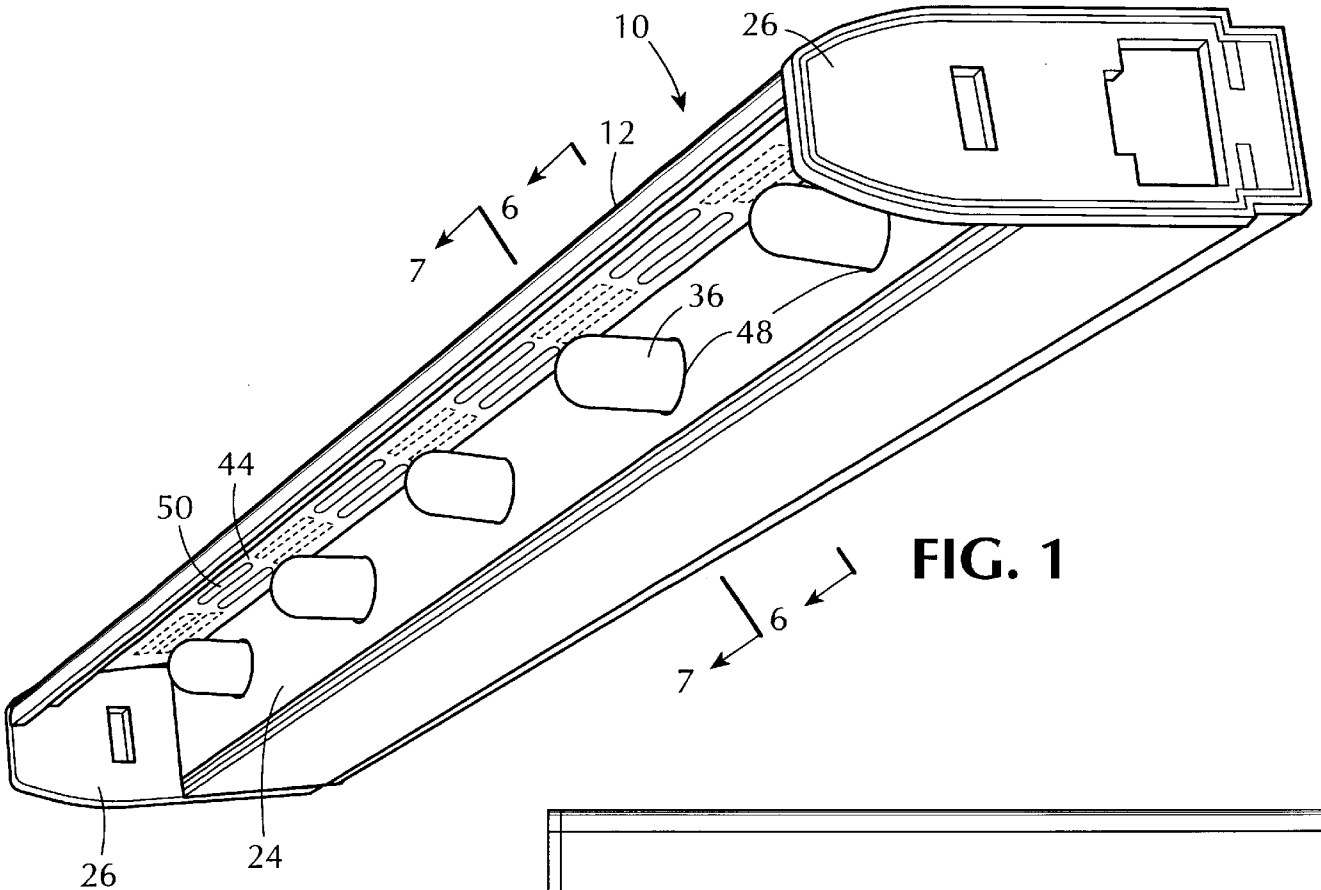
FIG. 1 is a perspective view of a modular lighting fixture constructed in accordance with the present invention.

Referring now to the drawing in detail, and initially to FIG. 1, a modular lighting unit or module 10, constructed in accordance with the present invention is illustrated. The lighting unit includes a housing 12 which, as seen in the cross-sectional view of FIGS. 6 and 7, includes a longitudinally extending top wall 14, a rear wall 16 and a bottom wall 18. This housing may be formed of extruded or rolled aluminum or the like.

Bottom wall 18 has a width dimension which is less than the width dimension of top wall 14, so that it defines a free front edge 20 located beneath top wall 14 of the housing, and inwardly of the front end 22 of the top wall to provide a space or opening 24 through which light may be emitted from the housing. The ends of the housing 12 are closed by end wall members 26 which are essentially of identical construction and preferably formed of molded plastic or the like. These end walls are removably mounted on the housing, as described hereinafter, in order to provide access thereto.

Figure 6:
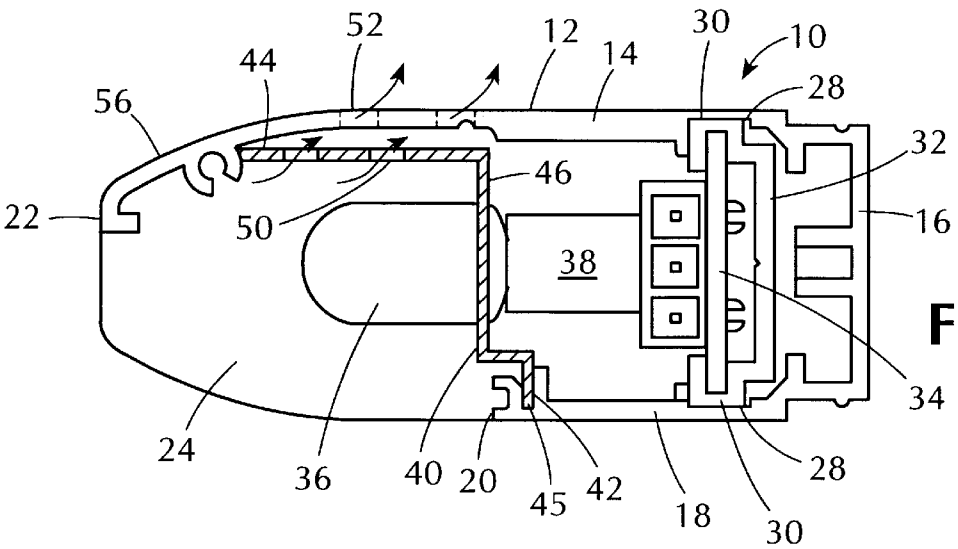
FIG. 6 is a sectional view taking along line 6—6 of FIG. 1.
Figure 7:
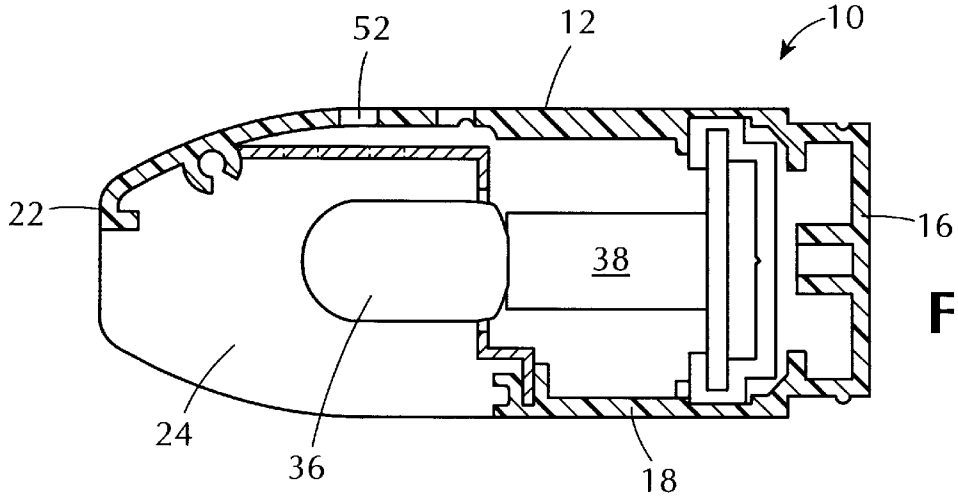
FIG. 7 is a sectional view taken along line 7—7 of FIG. 1.

Referring again to FIGS. 6 and 7, lighting module 10 includes a pair of opposed channels 28 formed therein adjacent rear wall 16. These channels receive the side edges 30 of an elongated channel-like bracket 32 which is slidably received in channels 28 through one end of the housing. The elongated bracket 32 provides support, as illustrated in FIG. 6, for a circuit board 34. The circuit board is either hardwired or has a printed circuit thereon for the purpose of supplying power to the series of light bulbs 36. These bulbs are mounted in conventional sockets 38 secured to the circuit board 34 in any convenient manner. Preferably the bulbs are fluorescent Xenon bulbs of low wattage. They are mounted to project beyond the free edge 20 of bottom wall 18, thereby to project light through the opening 24.

A reflector 40 is also mounted in housing 12. This reflector is supported in a channel 42 formed in the upper surface of bottom wall 18. Reflector 40 includes a top reflector wall 44 which is slightly spaced from top wall 14 and positioned between that top wall and bulbs 36. Reflector 40 also has a rear reflection wall 46 which extends generally perpendicularly to top wall 14. Its lower end 45 is supported in channel 42 as described above. Rear reflection wall 46 has a plurality of openings 48 formed therein through which the bulbs 36 project. Thus, the reflector is arranged to direct the light from the bulbs outwardly through opening 24.

Figure 2:
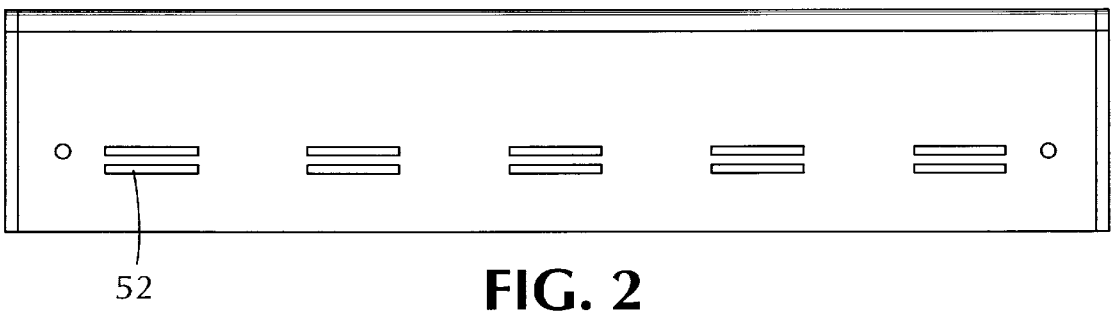
FIG. 2 is a plan view of the lighting fixture shown in FIG. 1.

Because bulbs 36 will produce a certain amount of heat, the area around the bulbs is preferably ventilated. To accomplish this, a plurality of groups of slots 50 are formed in reflector wall 44 in longitudinally-spaced locations along the length of the wall. These slots allow air heated by the bulbs to escape through the reflector into the space between the reflector and top wall 14. The latter also has a plurality of slots (also referred to herein as vent slots) 52 formed therein in spaced groups, as illustrated, for example, in FIGS. 2 and 6. However, slots 52 are arranged to be located between the groups of slots 50 (see FIG. 1) and laterally offset therefrom (see FIG. 6) so that a circuitous airflow path is formed. This circuitous airflow path arrangement allows air to flow out of the fixture, but prevents light from being projected upwardly through the top of the fixture. This is particularly important since these fixtures are generally intended to be mounted with the top surface of the wall 14 against or facing the bottom surface of a cabinet or the like.

As seen in FIG. 6, the curved arcuate nose portion 56 of the upper wall 14 of the housing will allow warm air exiting vent slots 52 to escape from beneath the cabinet surface.

Figure 3:
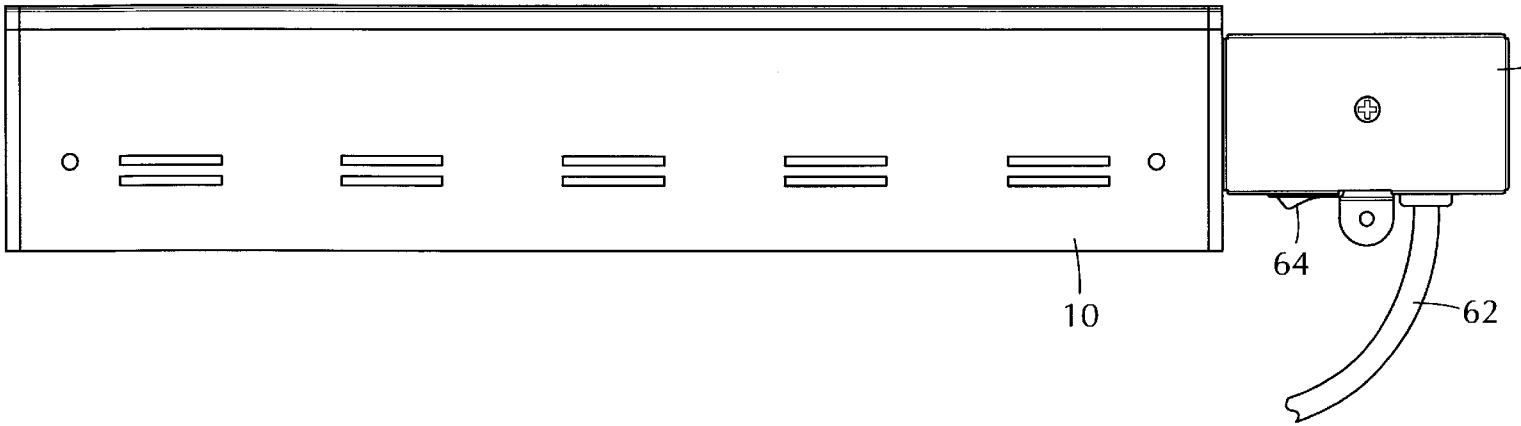
FIG. 3 is a plan view similar to FIG. 2 showing a plug-in power module attached to one end of the lighting fixture.
Figure 4:
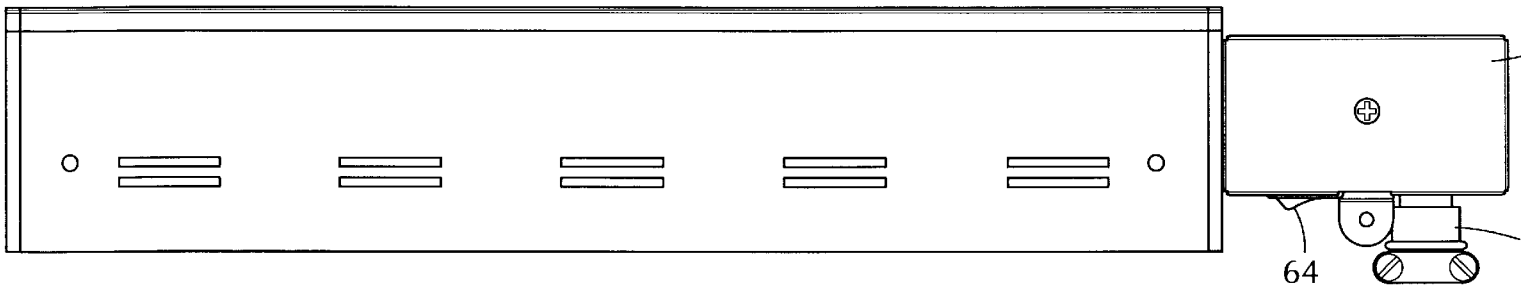
FIG. 4 is a plan view similar to FIG. 2 showing a BX cable powered power module connected to the lighting fixture.
Figure 5:
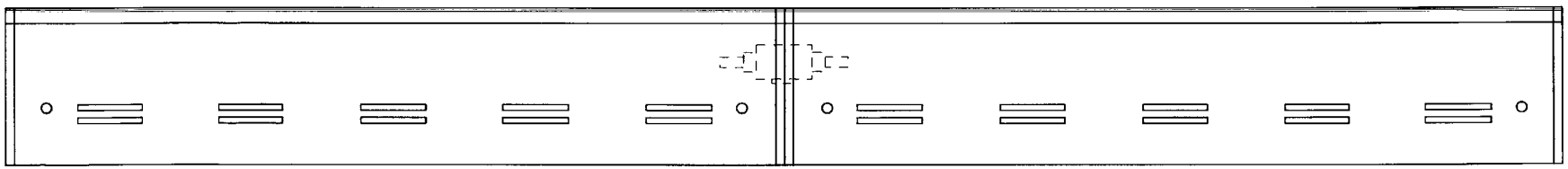
FIG. 5 is a plan view of two modules connected together at their opposing side walls.

Power is supplied to circuit board 34 by a power module such as shown, for example, in FIGS. 3 and 4. FIG. 3 illustrates a power module 60 which has a conventional power supply cord 62 whose end has a conventional plug 63 (see FIG. 9) which can be plugged into a conventional electrical socket to bring power to the module. In the module a switch (not shown) is connected to the power supply cord through a rocker switch control 64 to selectively shut power to lighting unit 10 on or off.

The power module 70 shown in FIG. 4 is of similar construction, except it provides for a BX cable mounting clamp 72 which is used to hardwire the fixture in place. However, it also has a rocker switch control 64 to allow the user to selectively turn power to the fixtures on and off.

The power modules, whether of the type shown in FIG. 3 or FIG. 4, are of essentially identical construction with regard to the manner of connection of the power module to the circuit board. More in particular, each module contains an electrical connector 80 (see FIGS. 8 and 9) of known construction as sold, for example, by the Molex Company under the trade name MINIFIT-BMI (for blind mating interconnect). These modular connectors have been sold in the past for high current/high density applications requiring blind mating of modules, subassemblies or printed circuit boards. They provide blind mating of wire to wire and have fully isolated terminals. This means that the terminals have their electrical connectors fully enclosed and not exposed to contact by the user. The power supply wiring 82 from the switch is connected in any known manner to the interior of the connector.

Figure 8:
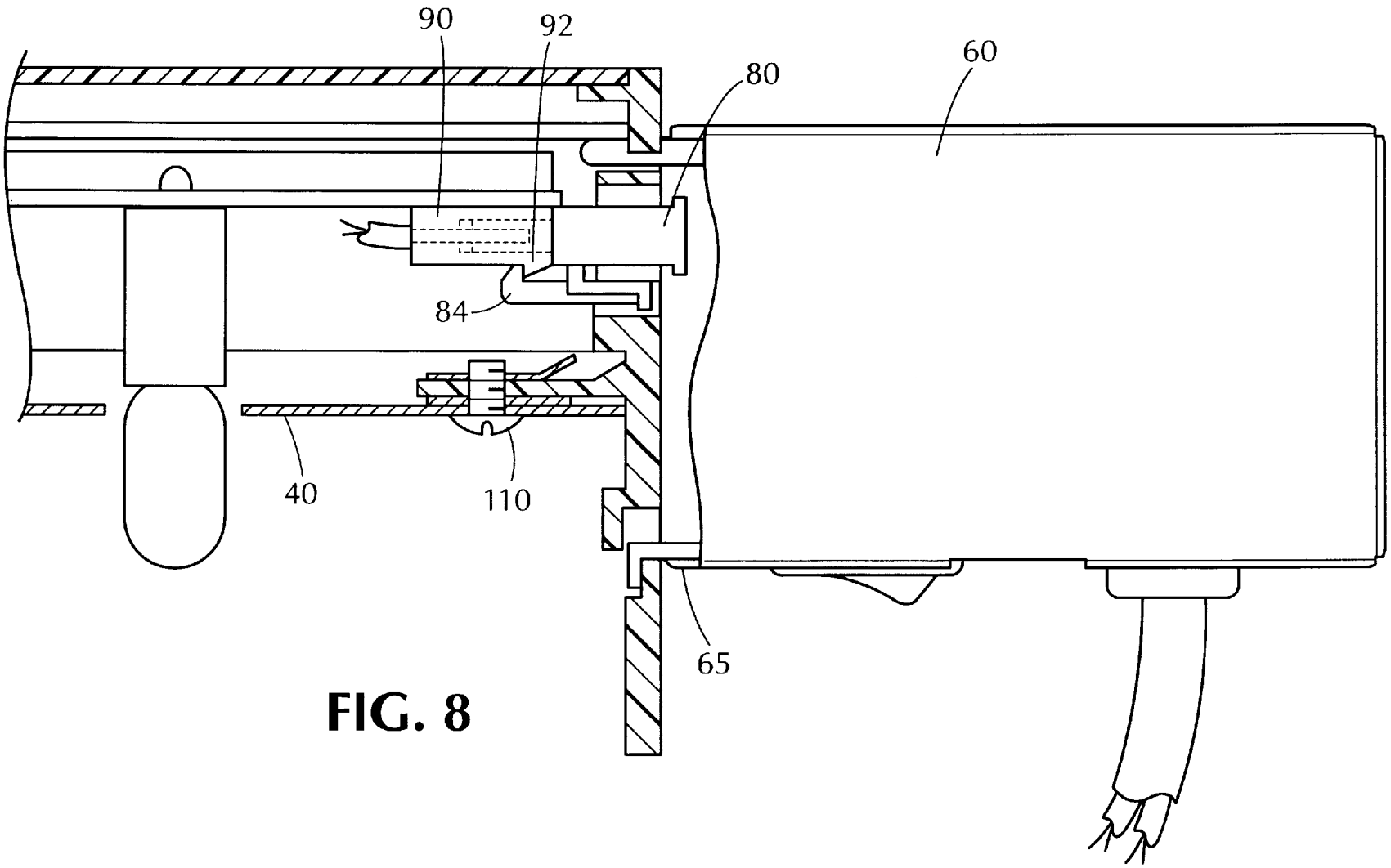
FIG. 8 is an enlarged plan view partially in section showing the connection between the lighting module and the power unit of FIG. 3.
Figure 9:
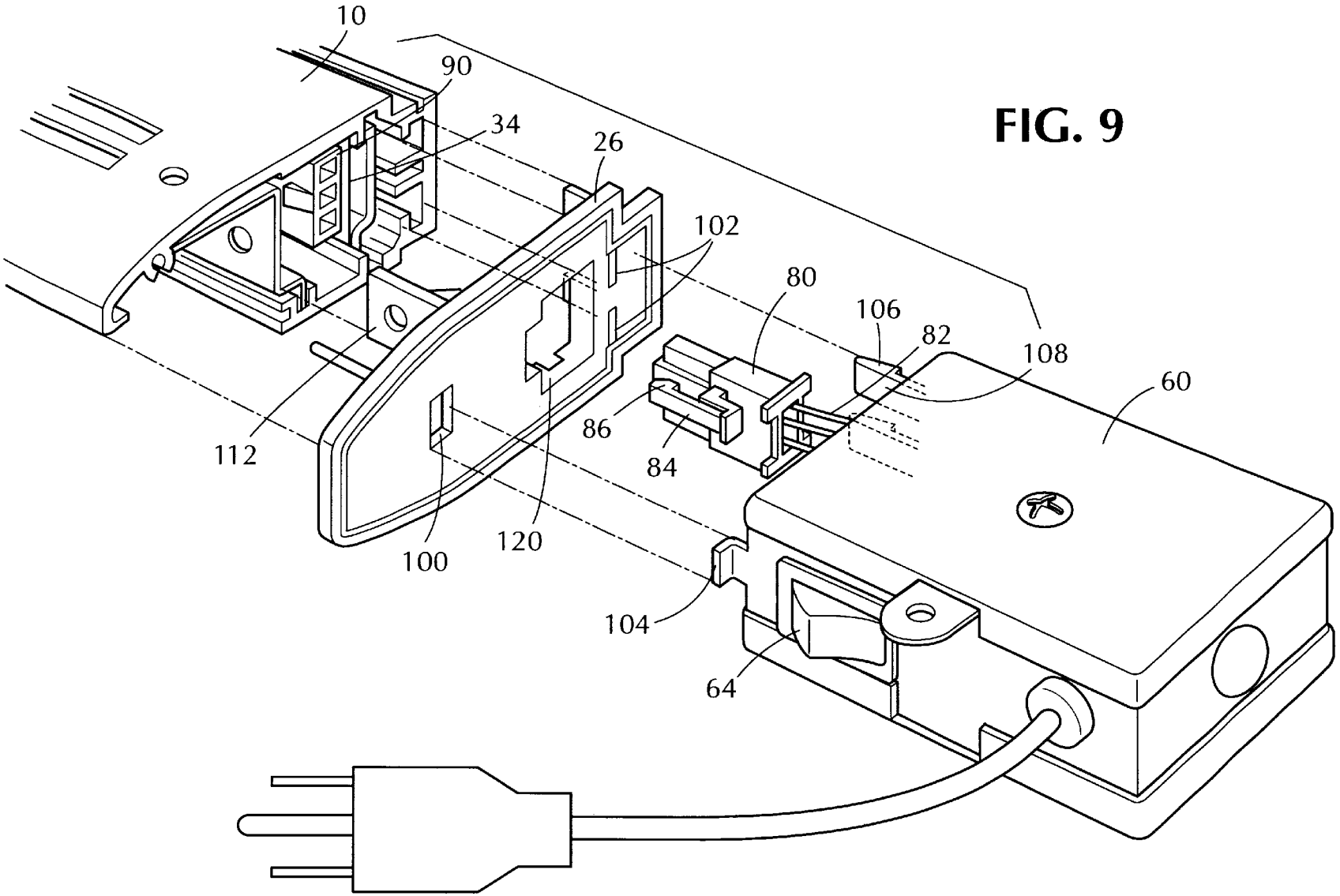
FIG. 9 is an exploded perspective view of the assembly shown in FIG. 8.

As seen in FIG. 9, the connector 80 on the power supply module 60 is a male connector and has a spring finger 84 formed on one side thereof, which includes a latch tab 86. When the power module is connected to the lighting fixture 10, the male connector mates with a female connector 90 mounted on circuit board 34. Female connector 90 has an abutment 92 formed thereon which engages with tab 86, as seen in FIG. 8, to positively mate the two connectors together.

In addition, end wall member 26 of the housing and the front face 65 of the power module have cooperating means to firmly hold the power module on the end of the housing when the connection between connectors 80 and 90 is made. More specifically, end wall member 26 has a rectangular aperture 100 formed therein, along with two smaller rectangular slots 102. Aperterure 100 receives the L-shaped tab 104 of module 60, while slots 102 receive the bayonet ends 106 of spring tabs 108, as seen in FIGS. 8 and 9. With this arrangement the power supply module is held firmly in place and a positive connection is made between the connectors 80 and 90.

End wall member 26 is secured on the end of the housing by a screw 110, as seen in FIG. 8, which is threaded through the rear reflector wall 40 of the reflector into the tab 112 formed on the inner face of the side wall.

Of course, as seen in FIG. 9, an opening 120, compatible with the cross-sectional configuration of the connector 80 is provided so that the connector can pass through the side wall for engagement with the connector 90. The side wall is provided with a frangible "knock-out" section (not shown) in the opening 120 which is removed when that side wall is to be used for connection to a power module or to another lighting module.

Figure 10:
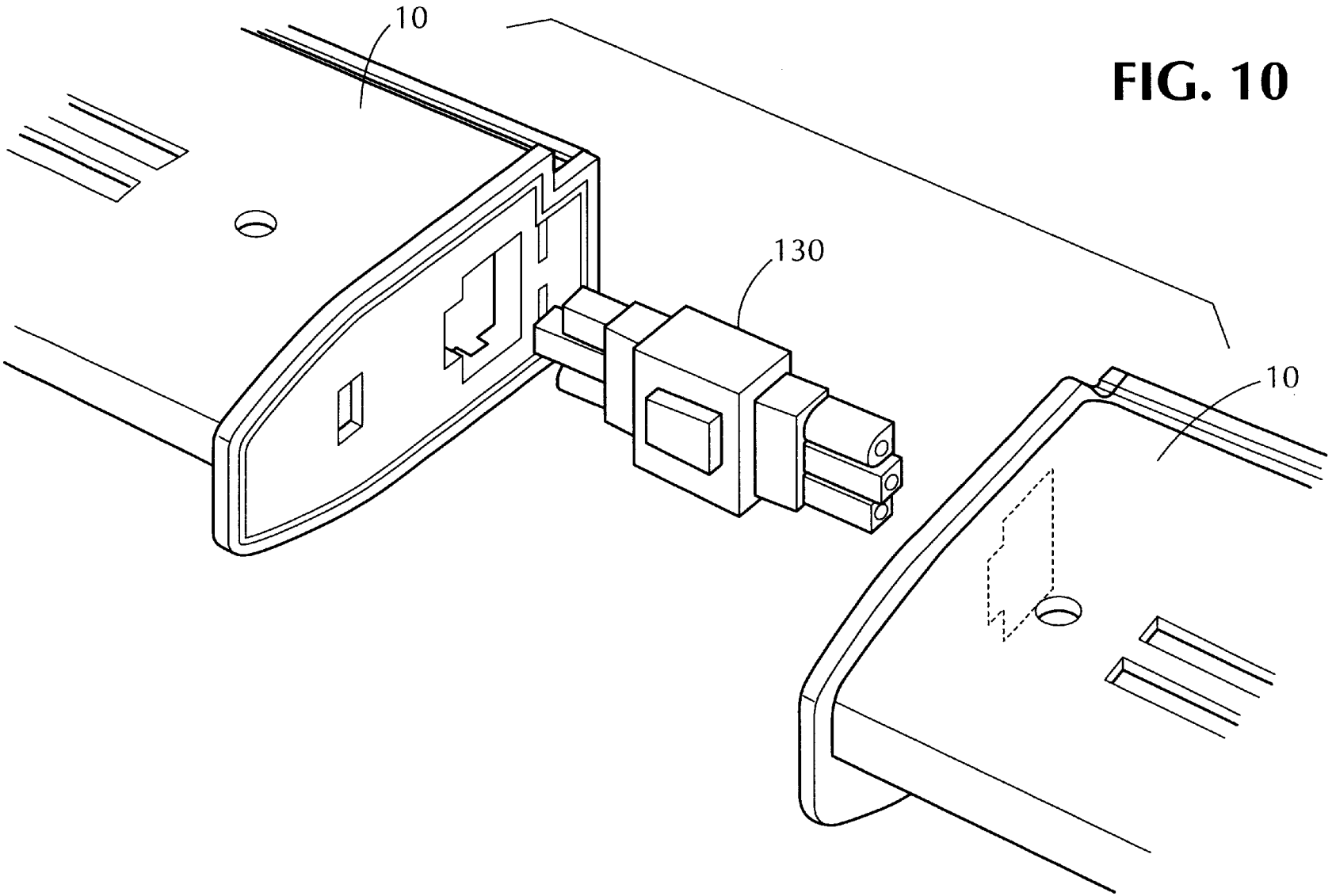
FIG. 10 is an exploded perspective view of the modular connection between two adjacent modular lighting fixtures.
Figure 11:
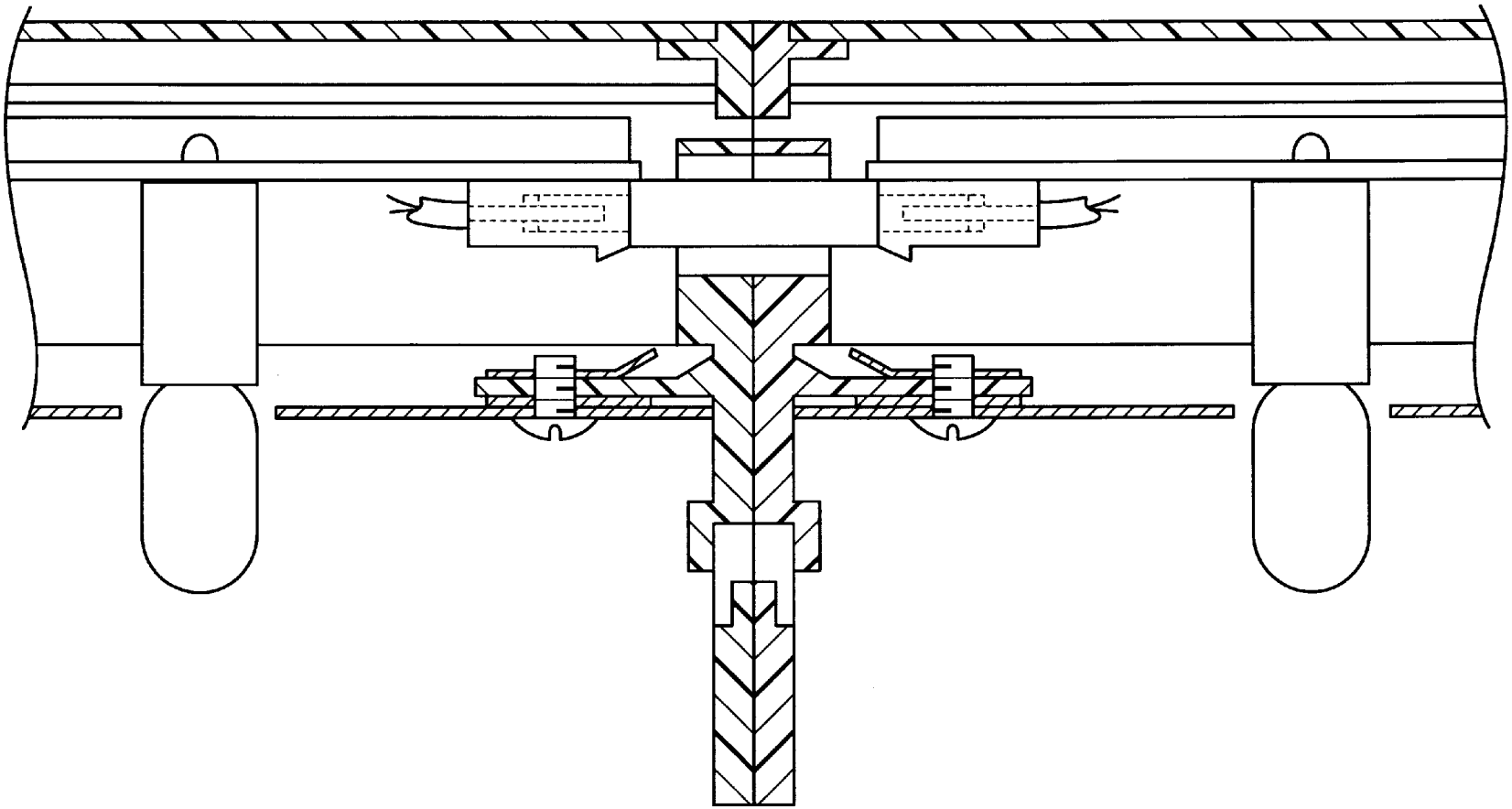
FIG. 11 is a sectional view shown through the connection illustrated in the perspective view of FIG. 10.

FIG. 10 illustrates a double ended male connector 130 which is adapted to provide a series connection between opposite ends of two lighting modules 10. The connector mates with the female modules in the end of the adjacent lighting fixtures, as seen in FIG. 11.

By this construction of the present invention, a modular lighting system is provide which is extremely safe to use and install. Because of the nature of the bulbs used, an extremely small fixture can be provided.

Once the first unit is electrically powered, the remaining units can be installed with the power on without danger to the installer. The individual units can be easily connected to one another and firmly secured in place.

Although various embodiments of the present invention have been described herein, it is to be understood that the invention is not limited to those precise embodiments and that various changes and modifications may be effected therein by those skilled in the art without departing from the scope or spirit of this invention.

What is claimed is:

1. A lighting fixture comprising an elongated housing having a top wall and a bottom wall; the width of said top wall being greater than the width of said bottom wall whereby said bottom wall has a free edge located below said top wall; at least one light bulb mounted in said housing on said bottom wall and projecting beyond said free edge of the bottom wall and below said top wall; a separate reflector mounted in said housing and having a reflector wall located below and spaced from said top wall and between said top wall and said at least one bulb, said reflector having a plurality of air vents formed therein; and said top wall having a plurality of air vents formed therein offset from the air vents in the reflector whereby air below the reflector wall heated by said at least one bulb will flow through the air vents in the reflector out the air vents in the top wall, but light will not be projected through the top wall.

2. A lighting fixture as defined in claim 1, wherein said at least one bulb is mounted on a circuit board, and said housing includes means for supporting said board between said top and bottom walls.

3. A lighting fixture as defined in claim 2, including a blind mating interconnect connector mounted on said board.

4. A lighting fixture as defined in claim 3, wherein said housing has opposed end walls and at least one of said walls has an opening formed therein providing access to said blind mating interconnect connector.

5. A lighting fixture as defined in claim 4, including a power supply module having a blind mating interconnect connector mounted therein which is complementary to and mates with the connector on the circuit board.

6. A lighting fixture as defined in claim 5, including cooperating means on the connectors on the wiring board and power module for securing the connectors together.

7. A lighting fixture as defined in claim 6, wherein said power module and side wall of the housing include cooperating means for securing the power module to the side wall.

8. A lighting fixture as defined in claim 7, wherein said cooperating means on the power module and side wall comprises first and second openings in the side wall; a hook projection on the power module for engagement in one of said openings and a spring finger on the power module for receipt in said second opening.

9. A lighting fixture comprising an elongated housing having a top wall, a bottom wall, and a pair of opposed side walls; said top wall having a width which is greater than the width of said bottom wall whereby said bottom wall has a longitudinal free edge located below the top wall; a plurality of light bulbs mounted in said housing and projecting beyond said free edge of the bottom wall and below said top wall; a reflector mounted in said housing having a reflector wall located below and spaced from said top wall and between said top wall and said bulbs, said reflector wall having a plurality of longitudinally-spaced air vents formed therein, each consisting of at least one slot formed in the reflector wall; and said top wall having a plurality of longitudinally-spaced air vents formed therein, each consisting of at least one slot; said bulbs being located below the reflector and between the said slots therein, said slots in the top wall of the housing being located between the slots in the reflector wall when the fixture is viewed in plan, whereby air below the reflector wall heated by said bulbs will flow through the air vents in the reflector out the air vents in the top wall while light passage out of the top wall is blocked.

10. A lighting fixture as defined in claim 9, wherein said plurality of longitudinally-spaced air vents in the reflector wall comprises a plurality of groups of at least two slots, each longitudinally spaced along the reflector wall, and said plurality of longitudinally-spaced air vents in the top wall of the housing comprises a plurality of groups of at least two slots, each longitudinally-spaced along the top wall of the housing in areas between groups of slots in the reflector wall and laterally offset therefrom, whereby a circuitous air flow path is provided for heated air venting from the housing.

11. A lighting fixture as defined in claim 10 including a circuit board mounted on said housing perpendicular to said top and bottom walls, said plurality of light bulbs being mounted on said board and projecting therefrom beyond said free edge of the bottom wall; said reflector having a first reflector wall located between the top wall and said bulbs and a rear reflector wall adjacent said circuit board, said rear wall having apertures therein through which said bulbs extend.

12. A lighting fixture as defined in claim 11, including a blind mating interconnect connector mounted on said board adjacent at least one of the side walls of the housing; said at least one side wall having an opening formed therein providing access to said blind mating interconnect connector.

13. A lighting fixture as defined in claim 12, including a power supply module having a blind mating interconnect connector mounted therein which is complementary to and mates with the connector on the circuit board.

14. A lighting fixture as defined in claim 13, including cooperating means on the connector on the wiring board and power module for securing the connectors together.

15. A lighting fixture as defined in claim 14, wherein said power module and side wall of the housing include cooperating means for securing the power module to the side wall.

16. A lighting fixture as defined in claim 15, wherein said cooperating means on the power module and side wall comprises a first and second opening in the side wall; a hook projection on the power module for engagement in one of said openings and a spring finger on the power module for receipt in said second opening.

* * * * *